US006164856A

United States Patent [19]

Lo

[11] Patent Number: 6,164,856

[45] Date of Patent: Dec. 26, 2000

[54] PEN WITH SELF-CONTAINED ILLUMINATION

[75] Inventor: Peter Lo, Taipei Hsien, Taiwan

[73] Assignee: Excel Scientech Co., Ltd., Taipei, Taiwan

[21] Appl. No.: 09/415,848

[22] Filed: Oct. 7, 1999

[51] Int. Cl.[7] ..... B43K 25/00

[52] U.S. Cl. ..... 401/52; 401/195; 362/118

[58] Field of Search ..... 401/52, 195, 49, 401/192; 362/118, 119, 120

[56] References Cited

U.S. PATENT DOCUMENTS

| | | | |
|---|---|---|---|
| 3,045,111 | 7/1962 | Hoenig | 401/195 |
| 4,016,414 | 4/1977 | Browning et al. | 401/195 |
| 5,673,996 | 10/1997 | Ducker | 401/195 |

FOREIGN PATENT DOCUMENTS

| | | | |
|---|---|---|---|
| 939349 | 1/1956 | Germany | 401/52 |

*Primary Examiner*—David J. Walczak
*Attorney, Agent, or Firm*—Darby & Darby

[57] ABSTRACT

A writing implement having a built-in illumination system includes a pen-top, a translucent pen-body, and a translucent pen-tip. A battery, an electrical switch and a lamp are housed within the pen-top so that light may be selectively generated by the lamp and directed generally along a central axis within the pen-body portion towards the pen-tip. A marking element is located within said pen-body, partially extending from said pen-tip. A lens is positioned between said lamp and said marking element so that light from the lamp is diverted away from the central axis to the pen-body which guides the received light to the pen-tip. Printed information located on the pen-body is illuminated, as well as a region located immediately adjacent to the pen-tip.

17 Claims, 2 Drawing Sheets

PEN WITH SELF-CONTAINED ILLUMINATION

BACKGROUND OF THE INVENTION

1. Field of the Invention

This invention generally relates to writing implements, and more specifically to pens having a self-contained source of illumination.

2. Description of the Prior Art

It is not uncommon to provide a writing implement, such as a pen, with a source of illumination so that the user of the lighted pen can effectively write on a surface in a dark environment. One early solution to the problem of writing in the dark included a conventional pen having a slim flashlight attached to the pen's body. In use, the writer held both the pen and the attached flashlight, with the flashlight illuminating the pen tip and the surrounding area of the writing surface.

This crude aggregate was quickly improved by essentially integrating the flashlight elements into the body of the pen so that the pen would contain the source of illumination, and since the bulky flashlight was eliminated, the improved lighted pen was easier to grasp and use.

The lighted pens of the prior art typically include a lamp (an LED or an incandescent type lamp), a battery, and a contact switch which controls the flow of current between the battery and the lamp. The lamp may be located anywhere within the pen body or pen top portion, as long as its light output is directed to the pen tip.

Since all of these prior art lighted pens require a battery and a switch, there is limited space available for the actual writing components of the pen, including the ink cartridge, the advancing mechanism which selectively advances the ink cartridge so that the tip projects from the lower end of the pen, and the return spring which retracts the cartridge. Typically, to maintain a slender lighted pen, the battery, switch and lamp components are positioned within the pen top portion and a shortened ink cartridge and an advancing mechanism are located in the pen body. Unfortunately, in these prior art lighted pens, as the light from the lamp passes through the transparent pen body, some of the light is blocked by the ink cartridge, and the advancing mechanism, resulting in less light reaching the pen tip and the writing surface. Also, as some of the light is blocked by the pen components (e.g., the ink cartridge), shadows are created on the writing surface which tend to be distracting to the user.

To help direct light to the very tip of the pen, a waveguide may be provided within the body of the pen, between the lamp and the pen tip. U.S. Pat. No. 4,518,274 of Hanggi discloses a lighted pen which includes a battery, switch, and a lamp, all located in a top portion of the pen. The pen body includes a waveguide which directs the light from the lamp through the pen-body to the pen-tip where the light may illuminate the writing surface. Unfortunately, much of the light from the lamp is directed to the writing components and therefore less light reaches the writing surface.

U.S. Pat. No. 4,890,204 of Lin et al. discloses a pen having a battery, switch and lamp all located within a top portion of the pen. Light from the lamp enters a hollow body portion of the pen and is directed to the pen tip by a reflective surface located along the inside walls of the pen body. Much of the light entering the pen body will be blocked (or otherwise reflected away from the pen tip) by the ink cartridge which is also located within the pen body.

One attempt to overcome the problem of directing light from the lamp to the pen-tip includes positioning the lamp as close as possible to the tip of the pen. U.S. Pat. No. 5,131,775 of Chen discloses an illuminating pen having a battery and switch located in a top portion of the pen, and an LED-type lamp located immediately adjacent to the tip of the pen. An advancing mechanism which is also positioned in the top of the pen, is used to selectively advance an ink cartridge sufficiently along the length of the pen to project the ink tip from the lower portion of the pen so that the pen may be used to write.

Although the lighted pen arrangement disclosed in U.S. Pat. No. 5,131,775 will provide light to the immediate vicinity of the pen tip, the pen is relatively complex because the lamp is positioned remote from its power supply and controlling switch. Also, since the LED lamp disclosed in U.S. Pat. No. 5,131,775 is located at the very tip of the pen, the LED lamp must be shaped similar to a truncated cone and must include a central bore to accommodate passage of the retractable ink cartridge. The LED lamp of this prior art lighted pen is not a readily available item and must be custom manufactured. Customizing parts for any device, such as this prior art pen will only increase the cost of the final product.

Although lighted pens having a light source that is located immediately adjacent to the pen tip, such as the pen disclosed in U.S. Pat. No. 5,131,775, effectively illuminate the pen tip and adjacent writing surface, the barrel of the pen (or the pen housing) remains dark during its operation, losing an opportunity to back-light a pattern, design, logo, advertisement, or indicia and display or otherwise creating an entertaining or decorative effect.

It would be beneficial to provide a lighted pen which includes a lamp, battery, and switch in a top portion of the pen and an ink cartridge and advancing mechanism located in a pen body, wherein the light from the lamp is directed through the pen, body around the ink cartridge and advancing mechanism to the tip. The light from the lamp should illuminate both the pen tip and simultaneously back-light a display portion of the pen body so that a pattern, design, logo, advertisement, or indicia located on the pen body may be illuminated when the pen is in use.

Accordingly, it is an object of the present invention to provide a lighted pen having a self-contained light source, which overcomes the deficiencies of the prior art.

It is another object of the present invention to provide such a lighted pen which includes a light source, a battery and a switch, wherein a display portion of the pen's housing and the pen tip are efficiently illuminated by a single light source.

It is another object of the present invention to provide such a lighted pen wherein the light from the lamp is directed to the pen tip and the display portion of the pen housing and not blocked by mechanical elements of the pen.

It is another object of the present invention to provide such a lighted pen which is inexpensive to manufacture and easy to operate.

It is another object of the present invention to provide a lighted pen having a translucent body, a top portion, and a self-contained light source wherein light generated from the light source is directed to both the pen tip and the walls of the translucent body.

SUMMARY OF THE INVENTION

The present invention is directed to a lighted pen in which logos on its transparent body and the pen tip are efficiently illuminated by means of a light source and a convex circular cylindrical optical lens.

In an illustrative embodiment of the invention a writing implement has a built-in illumination system that includes a pen-top, a translucent pen-body, and a translucent pen-tip. A battery, an electrical switch and a lamp are housed within the pen-top so that light may be selectively generated by the lamp and directed generally along a central axis within the pen-body portion towards the pen-tip. A marking element is located within said pen-body, partially extending from said pen-tip. A convex circularly cylindrical optical lens is positioned between said lamp and said marking element so that light from the lamp is diverted away from the central axis to the translucent pen-body and propagates to the pen-tip. As a result of the lens, printed information located on the pen-body is illuminated, as well as a region located immediately adjacent to the pen-tip.

BRIEF DESCRIPTION OF THE DRAWINGS

The foregoing and other features of the present invention will be more readily apparent from the following detailed description and drawings of an illustrative embodiment of the invention in which.

DETAILED DESCRIPTION OF THE ILLUSTRATIVE EMBODIMENT

Figure 1:
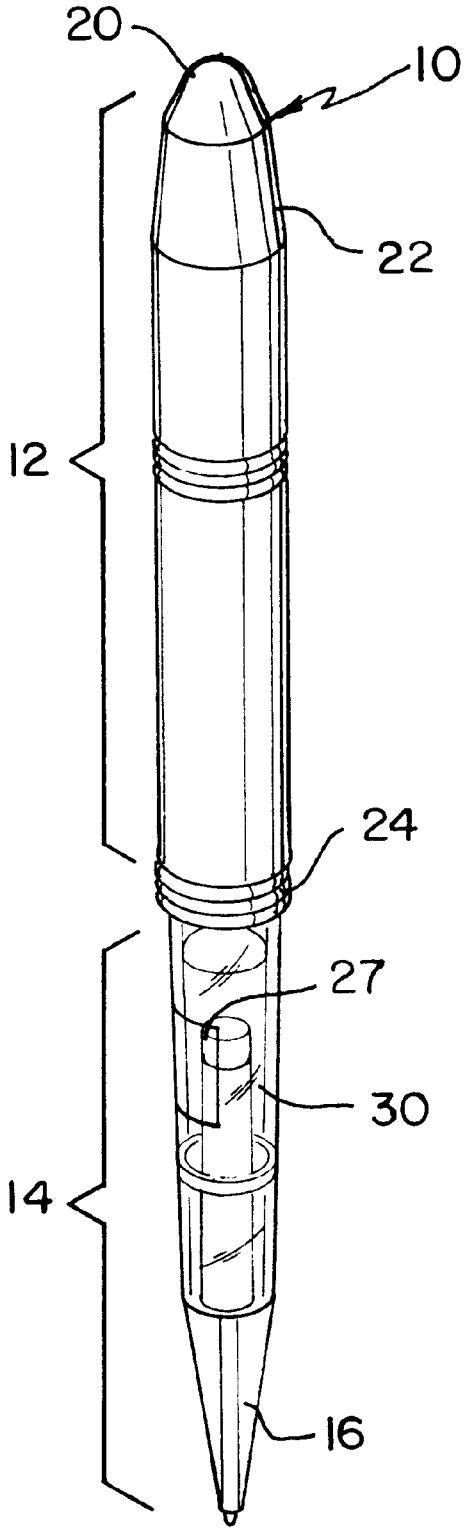
FIG. 1 is a perspective view of a lighted pen, according to the present invention, showing a pen top portion, a transparent pen body, and a pen tip.
Figure 2:
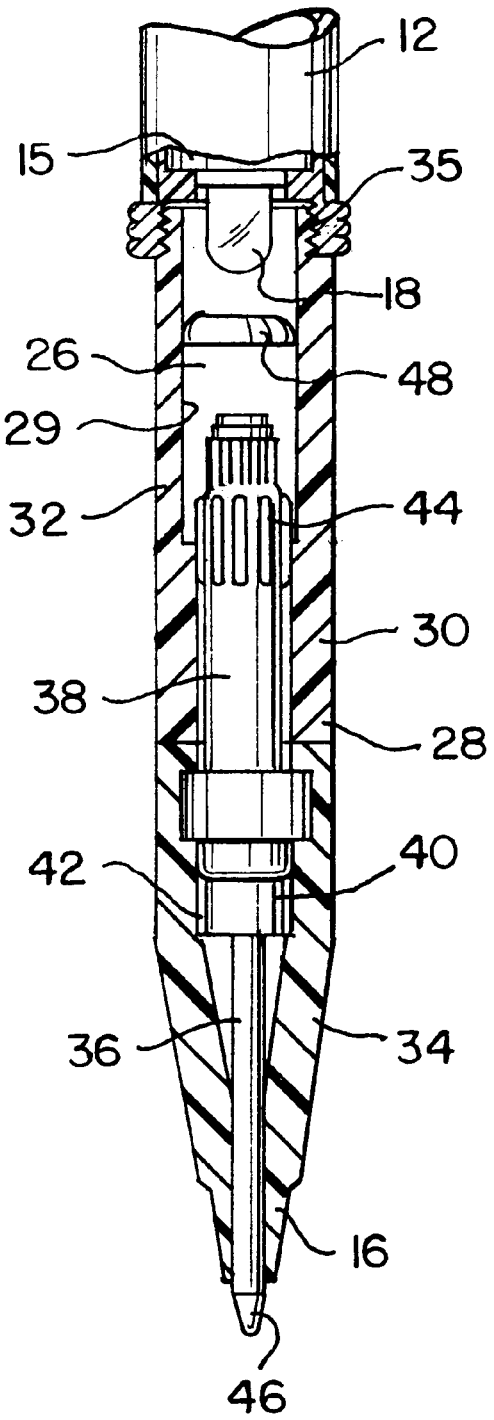
FIG. 2 is a partial sectional view of the pen body showing details of an advancing mechanism, a lamp, and a circularly cylindrical lens, according to the invention.

Referring to FIG. 1, a lighted pen 10 according to the present invention is shown including a top portion 12, and a body 14. A pen tip 16 is located at the bottom of body 14. Located within top portion 12 is a light emitting diode (LED) 18, an electrical switch 20, and a battery 15. As is known by those skilled in the art, LED 18 is electrically connected to switch 20 and the battery 15 so that when switch 20 is activated, LED 18 will illuminate, powered by the battery. Switch 20 is preferably located at an upper end 22 of top portion 12 and LED 18 is preferably positioned at an opposite end 24 of top portion 12, as shown in FIG. 2.

Body 14 functions as a waveguide, which efficiently and effectively transmits light from one point (adjacent the LED lamp 18) to another point (the pen tip 16) similar to an optical fiber. Body 14 includes a hollow portion 26 which extends the entire length of the body 14, and wall 28. As discussed in greater detail below, wall 28 is the part of the body 14 which functions as a waveguide by transmitting light from the LED lamp 18 to the pen tip 16. Wall 28 has an inner surface 29 which forms the boundary for hollow portion 26 and an outside surface 30 which forms the outer surface of body 14. Various patterns, designs, logos, advertisements, and/or indicia (referred to as "printed information 27 ") may be printed or otherwise positioned onto either inner surface 29, outside surface 30, or both. As described below, light emitted from LED lamp 18 illuminates the printed information (or pattern or design) when the lighted pen is turned on. The generated light will illuminate the printed information either as back-lighting if the printed information is located on the outside surface 30, or as front-lighting if the printed information is located on the inside surface 29.

Body 14 is preferably made from a material such as polymerized methyl methacrylate or any other transparent or translucent synthetic material (e.g. a resin) which is suitable for propagating light.

Body 14 is made up of two sections, an upper fixed section 32, and a lower grip section 34. Upper fixed section 32 is attached to top portion 12 (preferably by mating screw threads 35) at opposing end 24 of top portion 12. When body 14 is attached to top portion 12 (as shown in FIGS. 1 and 2) LED lamp 18 preferably extends into upper fixed section 32 of the body.

Both upper fixed section 32 and lower grip section 34 include the above-described hollow portion 26, which is adapted to receive an ink cartridge 36 and an advancing mechanism 38. Advancing mechanism 38, which may be conventional, is used to translate rotational movement into linear movement so that if two portions of a pen are rotated relative to each other, an ink cartridge is displaced linearly with respect to the pen body.

Advancing mechanism 38 includes a fixed portion 40 which is secured within hollow portion 26 of lower grip section 34 at a securing point 42, as shown in FIG. 2. Advancing mechanism 38 further includes a rotating portion 44 which is frictionally secured within hollow portion 26 of fixed section 32 of body 14. As understood by those skilled in the art, during operation of the advancing mechanism 38, as lower grip section 34 is rotated relative to fixed upper section 32 (and top portion 12 of pen 10), ink cartridge 36 linearly advances forward (or rearwardly retracted, depending on the direction of rotation) so that the pin tip 46 protrudes from section 34 or is retracted into it.

It is preferred that this type of rotational-to-linear advancing mechanism be used to advance ink cartridge 36 through the pen 10 of the present invention, however, other types of advancing mechanism may be used to linearly displace the ink cartridge 36, when desired, including a well known reciprocating (push and click) type of advancing, mechanism. Also, an advancing mechanism is not required to carry out the present invention. Ink cartridge 36 may be mounted within pen body 14 in such a manner that the tip portion 46 of ink cartridge 36 always projects beyond pen tip 16, as shown in FIG. 2.

Regardless of the type of advancing mechanism used, it is understood that at least an ink cartridge 36 (and possibly other advancing-related components) will be located within hollow portion 26 of pen body 14. These elements are opaque and unless circumvented, they will block a portion of the light emitted from the LED lamp 18 when the pen light is turned on.

To minimize attenuation of illumination intensity between the LED lamp 18 and the pen tip 16, a circular cylindrical or convex circular lens 48 is positioned within, or formed integrally with hollow portion 26 of upper fixed section 32 of pen body 14, preferably between ink cartridge 36 (or advancing mechanism 38) and LED lamp 18, as shown in FIG. 2.

Figure 3:
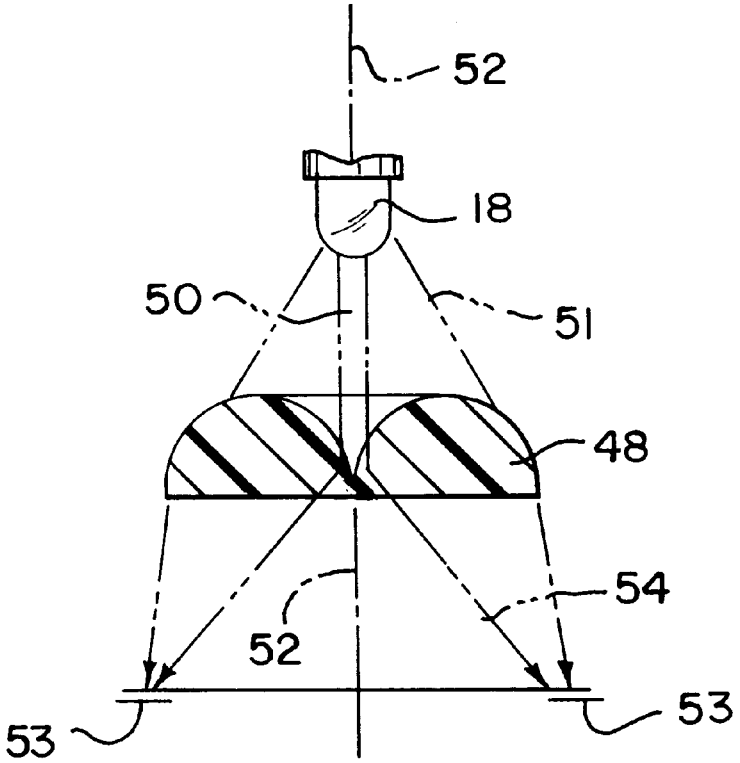
FIG. 3 is a sectional side view of a lens and lamp, showing representative light rays generated by the lamp being diverged by the lens, according to the invention.

Referring now to FIG. 3, LED lamp 18 is shown positioned adjacent to lens 48, in accordance with the present invention. Lens 48 is shaped similar to a halved toroid (or doughnut) shape, cut horizontally. As illustrated in FIG. 3, light rays 50 emitted from LED lamp 18 and which enter lens 48 generally parallel to a central axis, are caused to diverge outwardly away from the central axis 52. This divergence of light rays 50 away from the center portion concentrates most of the light output of LED lamp 18 away from the center of pen body 14 (and therefore away from the centrally located ink cartridge 36 and advancing mechanism 38) and towards the inside walls 29 of pen body 14 (as illustrated by light rays 54 in FIG. 3). The light from the LED will not all be parallel to the axis, some of its diverges as shown by line 51. However, all of the rays that strike lens 48 are caused to diverge from the center axis and as a result this divergence lens will form a circular focal "ring" of luminosity 53 whereby the central zone (near central axis 52) remains relatively dark. To this end, since most of the light rays 50 from LED lamp 18 are directed away from the centrally located opaque elements (i.e., ink cartridge 36 and advancing mechanism 38), then most of the light may be put to useful work, as described below, to illuminate either printed information or the writing surface adjacent to the pen tip. Lens 48 minimizes the amount of light from LED lamp 18 that would otherwise be lost (absorbed, reflected, or blocked) by the ink cartridge 36 and/or advancing mechanism 38.

Figure 4:
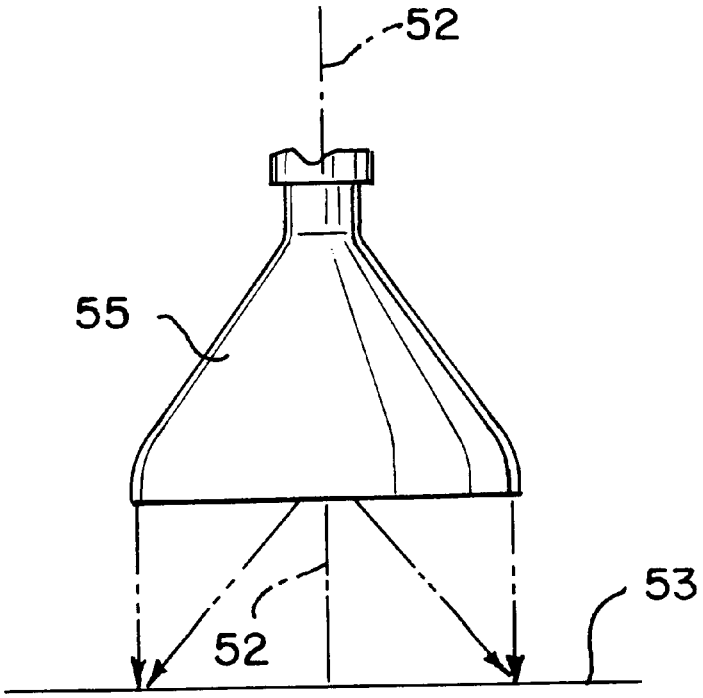
FIG. 4 is a side view of a lamp having an integrally formed lens, according to another embodiment of the invention.

Referring to FIG. 4, another embodiment of the invention is shown wherein the lamp and the lens are integrally formed as a single element 55.

In operation, when a user depresses switch 20, an electric current will flow between the battery 15 and the LED lamp 18, and LED lamp 18 will illuminate, emitting light rays 50. Light rays 50 will be directed through divergence lens 48 and diverted outwardly within hollow portion 26 to wall 28 of pen body 14. As discussed above, wall 28 will operate as an optical waveguide, transmitting the diverted light from lens 48 directly to pen tip 16, circumventing the centrally disposed components of the pen, including the ink cartridge 36 and the advancing mechanism 38. At the pen tip 16, the light will project onto the writing surface and illuminate it as useful illumination.

As the light rays 50 pass through wall 28 of pen body 14, a portion of the transmitted light will effectively back-light any printed information located on outside surface 30 of body 14 and front-illuminate any printed information located on inside surface 29 of wall 28. The amount of light passing through wall 28 (i.e., the waveguide) will depend on the material used to make body 14, its index of refraction, the amount of impurities located within the material (e.g. resin) used to make body 14 (such as air-bubbles), and the surface texture of both the inside surface 29 and the outside surface 30, that is anything which may reflect, defuse, or disperse the light passing through wall 28.

While the invention has been particularly shown and described with reference to a preferred embodiment thereof, it will be understood by those skilled in the art that various changes in form and details may be made herein without departing from the spirit and scope of the invention.

What is claimed is:

1. A writing implement having a built-in illumination system comprising:

a tubular housing having a central axis, a pen-top end and a pen-tip end, said tubular housing having a translucent portion which acts as a light conductor, said housing having a region adjacent to said pen-tip end which emits light being conducted therein;

a marking element located generally along said central axis within said tubular housing and extending to said pen-tip end, said marking element used to create a mark on a writing surface;

a lamp located within said tubular housing, said lamp being positioned so that its light output is generally directed along said central axis towards said pen-lip end; and a lens positioned within said tubular housing, said lens being sized and shaped so as to divert a major portion of said light output of said lamp from said central axis towards said translucent portion of said tubular housing, thereby illuminating a portion of said writing surface adjacent to said marking element.

2. The writing implement according to claim 1, further including a power supply to illuminate said lamp, said power supply being located within said tubular housing.

3. The writing implement according to claim 2, wherein said power supply is a battery located adjacent to said pen-top end within said tubular housing, said marking element is located adjacent to said pen-tip end, and said lamp is located between said battery and said marking element.

4. The writing implement according to claim 3, further comprising an electric switch electrically connected between said battery and said lamp to selectively control the flow of current between said battery and said lamp.

5. The writing implement according to claim 1, wherein said lamp is a light-emitting diode.

6. The writing implement according to claim 1, wherein said lens is positioned between said lamp and said marking element.

7. The writing implement according to claim 1, wherein at least said translucent portion of said tubular housing is made from polymerized methyl methacrylate.

8. The writing implement according to claim 1, wherein said lamp and said lens are integrally formed as a single element.

9. The writing implement according to claim 1, wherein said lens and said tubular housing are integrally formed.

10. The writing implement according lo claim 1, wherein said lens is a convex circular lens.

11. The writing implement according to claim 1, wherein said tubular housing having a second region in a middle section which emits light being conducted therein, and further including printed information on a surface of said housing adjacent said second region which is illuminated by the light emitted therefrom.

12. The writing implement according to claim 11 wherein the printed information is on an inner surface of said housing and is front lighted.

13. The writing implement according to claim 11 wherein the printed information is on an outer surface of said housing and is back lighted.

14. A writing implement having a built-in illumination system comprising:

a tubular housing having a central axis, a pen-top end and a pen-tip end, at least a portion of said tubular housing being translucent adjacent to solid pen-tip end;

a marking element located generally along said central axis within said tubular housing and extending to said pen-tip end, said marking element used to create a mark on a writing surface;

a lamp located within said tubular housing, said lamp being positioned so that its light output is generally directed along said central axis towards said pen-tip end;

printed information located on said outer surface of said translucent portion of said tubular housing;

a lens positioned within said tubular housing, said lens being sized and shaped to divert a portion of said light output of said lamp from said central axis towards said translucent portion of said tubular housing, said diverted light being transmitted by said translucent portion to said pen-tip end so that said writing surface adjacent to said marking element becomes illuminated.

15. The writing implement according to claim 14 further including a power supply to illuminate said lamp, said power supply being located within said tubular housing.

16. A The writing implement according to claim 14, wherein said diverted light back-illuminates at least a portion of said printed information.

17. The writing implement according to claim 14 wherein said diverted light front-illuminates at least a portion of said printed information.

* * * * *